United States Patent [19]

Dorsch et al.

[11] Patent Number: 4,523,568

[45] Date of Patent: Jun. 18, 1985

[54] CONTINUOUSLY OPERATING FUEL INJECTION SYSTEM

[75] Inventors: Heinz Dorsch, Weissach; August Hofbauer, Pforzheim; Herbert Steinbeck, Hemmingen, all of Fed. Rep. of Germany

[73] Assignee: Dr. Ing. h.c.F. Porsche A.G., Fed. Rep. of Germany

[21] Appl. No.: 541,434

[22] Filed: Oct. 13, 1983

[30] Foreign Application Priority Data

Oct. 13, 1982 [DE] Fed. Rep. of Germany ..... 3237963

[51] Int. Cl.[3] ..... F02M 39/00

[52] U.S. Cl. ..... 123/453; 123/380; 123/383

[58] Field of Search ..... 123/453, 454, 455, 380, 123/383

[56] References Cited

U.S. PATENT DOCUMENTS

| | | | |
|---|---|---|---|
| 3,680,536 | 8/1972 | Clark | 123/453 |
| 3,739,758 | 6/1973 | Knapp | 123/453 |
| 3,974,811 | 8/1976 | Stumpp | 123/453 |
| 3,993,034 | 11/1976 | Passera | 123/453 |
| 3,999,527 | 12/1976 | Wessel | 123/453 |

FOREIGN PATENT DOCUMENTS

| | | | |
|---|---|---|---|
| 1751674 | 10/1971 | Fed. Rep. of Germany | 123/453 |
| 2327295 | 1/1975 | Fed. Rep. of Germany | 123/453 |

*Primary Examiner*—Carl Stuart Miller

*Attorney, Agent, or Firm*—Craig and Burns

[57] ABSTRACT

A continuously operating fuel injection installation which includes an air-quantity measuring device in the suction pipe and a fuel-quantity distributor controlled thereby, is equipped for use with a multi-cylinder aircraft engine, with an auxiliary device that serves to achieve the best possible power output, fuel economy and flight safety; for that purpose, a height control pressure regulator is connected to the control pressure line leading to the fuel-quantity distributor in parallel to a warm-up regulator, which meters the control pressure and therewith the fuel admixture corresponding to the air density changing with temperature and pressure; by interconnecting a fixed throttle between the control pressure line and the fuel return line to the fuel tank, an emergency operation of the engine is assured in case of failure of both regulators.

18 Claims, 1 Drawing Figure

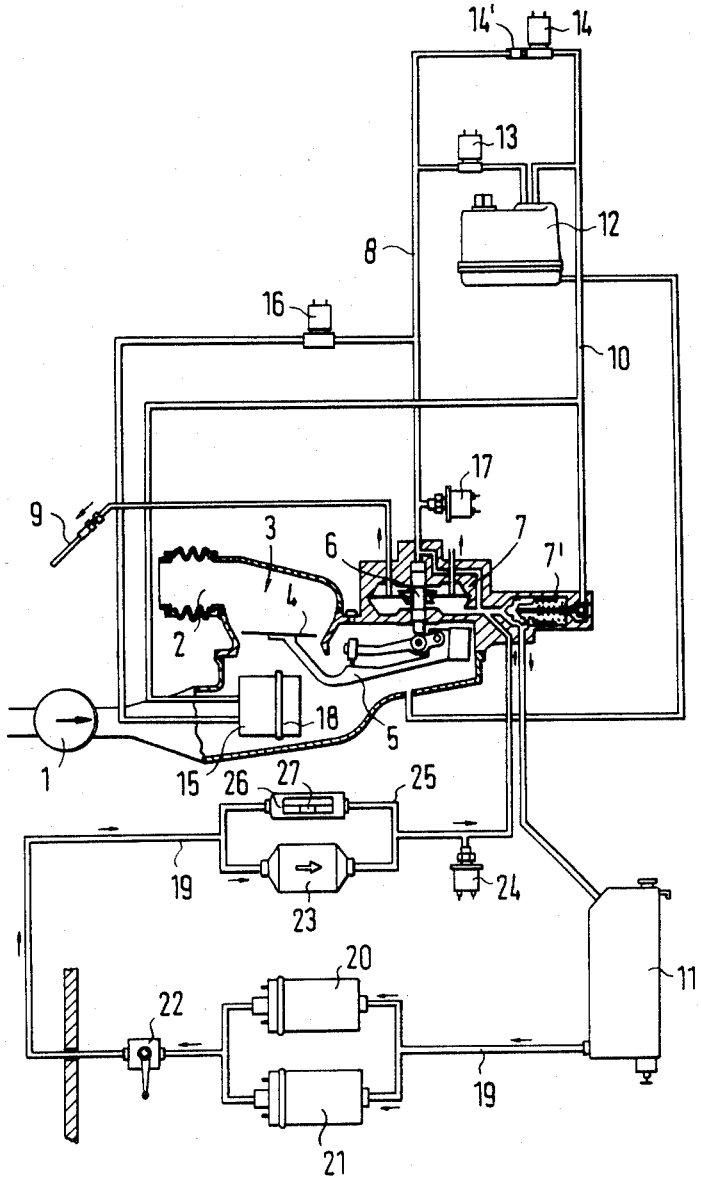
14'
14
13
12
8
16
10
17
9
3
6
7
7'
4
2
18
5
1
15
26
27
25
19
24
23
20
11
22
19
21

CONTINUOUSLY OPERATING FUEL INJECTION SYSTEM

The present invention relates to a continuously operating fuel injection system, especially for a multi-cylinder aircraft engine.

Such a fuel injection system is disclosed in the German Offenlegungsschrift No. 23 27 295. In this prior publication which includes a warm-up regulator, which at temperatures below the engine operating temperature acts on the pressure-regulating valve of the control pressure line against the force of a first control spring, a second control spring is installed in parallel to the first control spring whose prestress is variable in dependence on the atmospheric pressure. The influence of the atmospheric pressure which changes with the geodetic height, on the fuel admixture, respectively, on the formation of the fuel-air mixture is to be compensated thereby. It is disadvantageous with this construction that the two characteristic magnitudes of engine operating temperature and atmospheric pressure determine the control pressure by their common interaction and no decoupled interaction is possible which is desirable in particular for aircraft engines. For whereas during the start of the engine and the following brief warm-up period, only the warm-up regulator is required, during normal flying condition a metering of the control pressure corresponding to the pressure and the temperature of the sucked-in air is required.

The task of the present invention essentially resides in so constructing the fuel installation that these requirements can be fulfilled and the operationally reliable function of the engine with best possible output and with low fuel consumption and low harmful emission is assured at every geodetic height of the engine.

The underlying problems are solved according to the present invention in that a height control pressure regulator is installed between the control pressure line and the return line in parallel with the warm-up regulator. Since the height control pressure regulator and the warm-up regulator are connected as separate aggregates between the control pressure line and the return line, the one or the other regulator can be selectively used for the determination of the control pressure. Electromagnetic valves are thereby connected either ahead or behind the two regulators which are actuatable either automatically or manually by switching. The feed line to the warm-up regulator is closed by means of these electromagnetic valves after the termination of the warm-up phase of the engine and the feed line to the height control pressure regulator is opened at that time. This system also serves the safety of the flying operation, for if the height control pressure regulator fails, which is indicated by a further height-measuring device, it can be turned off and the warm-up regulator can be additonally interconnected which though not assuring a good efficiency of the engine, enables the functionally reliable operation thereof up to a landing of the aircraft. As a further safety measure, a fixed throttle is installed between the control pressure line and the return line in parallel to the warm-up regulator, whose through-flow cross section is so dimensioned that in case of failure of the height control pressure regulator and of the warm-up regulator, a correct fuel supply takes place at a predetermined height and upon leaving this height, a still sufficient fuel supply of the aircraft engine is assured until an emergency landing.

For purposes of measuring the air condition, the height control pressure regulator includes a diaphram box which in contrast to the known evacuated diaphram boxes, is filled with a gas. The gas-filled box selected therefor expands proportionally to the air density; the proportionality factor includes technical and physical properties of the system. The air quantity measuring device in the suction pipe reacts to the air density prevailing thereat which, for example, is less as a result of the higher temperature than the air density of the atmosphere surrounding the aircraft. It is, therefore, appropriate to arrange the diaphragm box of the height control pressure regulator and/or the entire height control pressure regulator also in the suction pipe directly ahead of the air quantity measuring device in order to be able to detect the actual measuring values of the air reaching the engine and to be able to feed the same as a correcting value to the input of the fuel admixture device. With supercharged engines, the location of the installation of the air quantity measuring device and of the height control pressure regulator downstream of the compressor entails the advantage that it impairs less the operation of the engine because the pressure loss unavoidable by the installation occurs on the pressure side of the compressor and, as a result thereof, is less harmful than on the suction side. Additonally, the possibility is created thereby to remove compressed air for other purposes without falsifying the mixture regulation.

These and other objects, features and advantages of the present invention will become more apparent from the following description when taken in connection with the accompanying drawing which shows, for purposes of illustration only, one embodiment in accordance with the present invention, and wherein:

The single FIGURE is a somewhat schematic view of a continuously operating fuel injection installation in accordance with the present invention.

Referring now to the single FIGURE of the drawing, air is supplied from a turbocharger 1 into the suction pipe 2 of a multi-cylinder aircraft engine, in which is located an air quantity measuring device generally designated by reference numeral 3. The air quantity measuring device 3 is a disk 4 arranged transversely to the direction of flow of the air, whose adjusting movement dependent on the through-flow quantity is transmitted by way of a rotatably supported lever 5 to one end face of the control piston 6 of a fuel-quantity distributor 7 having a control valve 7'. The other end face of the control piston 6 is acted upon by the pressure of a control line 8, which acts as return force for the air quantity measuring device 3. Depending on the position of the control piston 6, more or less fuel is distributed uniformly to the injection valves 9, of which one each is coordinated to a respective cylinder of the aircraft engine.

A warm-up regulator 12 which is installed between the control pressure line 8 and the return line 10 of the fuel leading to the fuel tank 11, may be of the type described in "Bosch, Technische Unterrichtung, Benzineinsprutzung K-Jetronic",Feb. 28, 1974, pages 14 and 15. An electromagnetic valve 13 is connected ahead of the warm-up regulator 12 which is actuatable either automatically or manually by switching. An electromagnetic valve 14 with a fixed throttle 14' is connected between the control pressure line 8 and the return line 10 in parallel to the warm-up regulator 12 while a height control pressure regulator 15 is installed in a further parallel line which is also adapted to be engaged and disengaged by an electomagnetic valve 16 connected ahead thereof. The pressure of the control line 8 is monitored by a pressure-measuring device 17 connected thereto. The height control pressure regulator 15 which includes a gas-filled diaphram box 18, is arranged in the suction pipe directly below the disk 4 of the air quantity measuring device 3 and thus measures the temperature and the pressure of the air supplied by the turbocharger 1 at the same location, at which is also determined the through-flow quantity by the air quantity measuring device 3.

The fuel supply takes place by way of two electric fuel pumps 20 and 21 arranged in parallel in a feed line 19, which suck in the fuel out of the fuel tank 11 and feed the same to the fuel quantity distributor 7 by way of a manually actuated valve 22 and a fuel filter 23. A pressure-measuring device 24 is connected to the line from the fuel filter 23 to the fuel quantity distributor 7 which controls the fuel pumps 20 and 21 by way of built-in switching contacts. A differential pressure limiting valve 26 is connected into a by-pass line 25 by-passing the fuel filter 23, which is equipped with a filter-soiling indicator 27.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A continuously operating fuel injection installation, comprising a suction pipe, air quantity measuring means for the through-flowing air quantity arranged in the suction pipe, a fuel quantity distributor means including a control piston means for distributing the fuel to injection valve means, said air quantity measuring means acting on one end face of the control piston means, the other end face of the control piston means being acted upon by a control pressure line whose pressure is controlled by a warm-up regulator means, a return line leading from said warm-up regulator means to a fuel tank, height control pressure regulator means connected between said control pressure line and said return line in parallel to the warm-up regulator means electromagnetic valve means operatively connected with the warm-up regulator means and the height control pressure regulator means, said electromagnetic valve means being disposed in the return line upstream of the warm-up regulator means and the height control pressure regulator means.

2. A fuel injection installation according to claim 1, wherein the engine is a multi-cylinder aircraft engine.

3. A continuously operating fuel injection installation, comprising a suction pipe, air quantity measuring means for the through-flowing air quantity arranged in the suction pipe, a fuel quantity distributor means including a control piston means for distributing the fuel to injection valve means, said air quantity measuring means acting on one end face of the control piston means, the other end face of the control piston means being acted upon by a control pressure line whose pressure is controlled by a warm-up regulator means, a return line leading from said warm-up regulator means to a fuel tank, height control pressure regulator means connected between said control pressure line and said return line in parallel to the warm-up regulator means, electromagnetic valve means operatively connected with the warm-up regulator means and the height control pressure regulator means, said electromagnetic valve means being connected downstream of the warm-up regulator means and the height control pressure regulator means.

4. A fuel injection installation according to claim 1, wherein one electromagnetic valve means is opened while the other is closed and vice versa.

5. A fuel injection installation according to claim 1, wherein both electromagnetic valve means are operable to be opened, respectively, closed at the same time.

6. A continuously operating fuel injection installation, comprising a suction pipe, air quantity measuring means for the through-flowing air quantity arranged in the suction pipe, a fuel quantity distributor means including a control piston means for distributing the fuel to injection valve means, said air quantity measuring means acting on one end face of the control piston means, the other end face of the control piston means being acted upon by a control pressure line whose pressure is controlled by a warm-up regulator means, a return line leading from said warm-up regulator means to a fuel tank, height control pressure regulator means connected between said control pressure line and said return line in parallel to the warm-up regulator means, said height control pressure regulator means including a diaphragm box means filled with a gas operable for changing the control pressure, said diaphragm box means of the height control pressure regulator means being arranged in the suction pipe upstream of the air quantity measuring means in order to measure directly the air condition prevailing thereat.

7. A continuously operating fuel injection installation, comprising a suction pipe, air quantity measuring means for the throughflowing air quantity arranged in the suction pipe, a fuel quantity distributor means including a control piston means for distributing the fuel to injection valve means, said air quantity measuring means acting on one end face of the control piston means, the other end face of the control piston means being acted upon by a control pressure line whose pressure is controlled by a warm-up regulator means, a return line leading from said warm-up regulator means to a fuel tank, height control pressure regulator means connected between said control pressure line and said return line in parallel to the warm-up regulator means, said height control pressure regulator means including a diaphragm box means filled with a gas operable for changing the control pressure, said diaphragm box means of the height control pressure regulator means being arranged in the suction pipe upstream of the air quantity measuring means in order to measure directly the air condition prevailing thereat with a temperature increase and with increasing geodetic height, respectively, decreasing air pressure in such a manner that the fuel quantity is metered corresponding to the density of the sucked-in air which changes with the temperature and the pressure, said diaphragm box means of the height control pressure regulator means being arranged in the suction pipe upstream of the air quantity measuring means in order to measure directly the air condition prevailing thereat.

8. A fuel injection installation according to claim 7, wherein the entire height control pressure regulator means is arranged in the suction pipe upstream of the air quantity measuring means.

9. A fuel injection installation according to claim 7, wherein a fixed throttle means having a predetermined constant through-flow cross section is arranged between the control pressure line and the return line in parallel to the warm-up regulator means.

10. A fuel injection installation according to claim 9, wherein the installation is operatively associated with an engine supercharged by a compressor and said air quantity measuring means together with the height control pressure regulator means are arranged downstream of the compressor of a turbocharger on the pressure side thereof.

11. A fuel injection installation according to claim 10, wherein the engine is a multi-cylinder aircraft engine.

12. A fuel injection installation according to claim 10, wherein electromagnetic valve means are operatively connected with the warm-up regulator means and the height control pressure regulator means.

13. A fuel injection installation according to claim 1, wherein a fixed throttle means having a predetermined constant through-flow cross section is arranged between the control pressure line and the return line in parallel to the warm-up regulator means.

14. A fuel injection installation according to claim 1, wherein said installation in operatively associated with an engine supercharged by a compressor and said air quantity measuring means together with the height control pressure regulator means are arranged downstream of the compressor of a turbocharger on the pressure side thereof.

15. A fuel injection installation according to claim 3, wherein the engine is a multicylinder aircraft engine.

16. A fuel injection installation according to claim 6, wherein a fixed throttle means having a predetermined constant through-flow cross section is arranged between the control pressure line and the return line in parallel to the warm-up regulator means.

17. A fuel injection installation according to claim 16, wherein the installation is operatively associated with an engine supercharged by a compressor and said air quantity measuring means together with the height control pressure regulator means are arranged downstream of the compressor of a turbocharger on the pressure side thereof.

18. A fuel injection installation according to claim 17, wherein the engine is a multicylinder aircraft engine.

* * * * *